United States Patent [19]

Dyhr et al.

[11] 4,184,810

[45] Jan. 22, 1980

[54] COMPRESSOR UNIT, PARTICULARLY FOR REFRIGERATORS

[75] Inventors: Jan Dyhr, Sonderborg; Bent Karll, Augustenborg; Hans C. Andersen, Sonderborg, all of Denmark

[73] Assignee: Danfoss A/S, Nordborg, Denmark

[21] Appl. No.: 881,398

[22] Filed: Feb. 27, 1978

[30] Foreign Application Priority Data

Mar. 2, 1977 [DE] Fed. Rep. of Germany ..... 2709002

[51] Int. Cl.[2] ..... F04B 35/04; F04B 19/02

[52] U.S. Cl. ..... 417/363; 417/415; 417/462; 417/372

[58] Field of Search ..... 417/415, 419, 462, 372, 417/363

[56] References Cited

U.S. PATENT DOCUMENTS 2,618,430 11/1952 Smith ..... 417/419 X 2,935,244 5/1960 Dills ..... 417/415

3,836,290 9/1974 Carthe ..... 417/415

*Primary Examiner*—Richard E. Gluck

*Attorney, Agent, or Firm*—Wayne B. Easton

[57] ABSTRACT

The invention relates to a refrigerator type motor-compressor assembly. The housing includes inner and outer tubular shaped casings with the inner casing in which the motor and compressor units are mounted being resiliently mounted relative to the outer casing. The cylinder block is rotatable with the motor shaft with the cylinder thereof extending transversely relative to the shaft. A piston in the cylinder is actuated by a pin carried by an annularly shaped member which is rotatable about a stationary, cylindrically shaped track member. The track member is eccentrically disposed relative to the axis of the motor shaft. An antechamber is provided on an end wall of the inner casing to form an isolated chamber between the inner and outer casings. The antechamber is utilized to provide for the exhausting of pressurized gas from the rotatable cylinder block.

13 Claims, 3 Drawing Figures

COMPRESSOR UNIT, PARTICULARLY FOR REFRIGERATORS

The invention relates to a compressor unit, particularly for refrigerators, comprising an electric motor of which the stator is held in a housing which also carries the bearing arrangement for the motor, and a piston compressor of which the cylinder block rotates with the rotor, the piston is guided on a circular track eccentric with respect to the rotor, and the pressure conduit comprises a rotary section and a section fixed with respect to the housing.

In a known compressor unit with vertical axis, the mounting of the rotor and the cylinder block is effected on a fixed pin. This has suction and pressure conduit sections which are fixed with respect to the housing and each of which is connected to a peripheral aperture. These are consecutively controlled by a respective control aperture of the cylinder block associated with each cylinder. Four pistons are provided which are supported by ball bearings against an inwardly directed eccentric surface. For this purpose considerable space is required and therefore the housing is enlarged. The unit is built together with a liquefier and a liquid collector. An outer sleeve is tightly joined to the housing. This unit is large and loud. It is also known to accommodate a refrigerant compressor unit resiliently in a capsule under vacuum so as to keep the outwardly penetrating noises low. In this case the oil collecting chamber is disposed at the base of the capsule. In the case of reciprocating piston compressors, the cylinder block is covered by a cylinder cover having a suction valve chamber and a pressure valve chamber as well as suction and pressure plate valves. These compressor units likewise have a minimum size which the unit cannot be built.

The invention is based on the problem of providing a compressor unit of the aforementioned kind, particularly for refrigerators, which can be kept extraordinarily small and for example has two minimum dimensions of less than 10 cm and works with little noise.

This problem is solved according to the invention in that the housing is substantially tubular and resiliently supported in a capsule under vacuum, that the bearing arrangement is formed by a partition which is disposed within the housing and comprises a bearing traversed by a motor shaft carrying the rotor on one side and the cylinder block on the other and a cylindrical eccentric surface on which a guide element supporting the piston rotates, and that the rotary pressure conduit section is sealed at the free end of the cylinder block and co-operates with the pressure conduit section which is fixed with respect to the housing and which is formed at a first end wall of the tubular housing.

With this construction, the cross-section of the housing is determined by the cross-section of the motor. Since the eccentric surface and the entrainment need not project considerably beyond the cylinder block, the thus available housing cross-section is also sufficient for the compressor arrangement. By relocating the transition to the end of the cylinder block from the rotary to the fixed pressure conduit section, a fixed bearing pin of comparatively large diameter can be omitted. The low noise level occurs not only because the housing is resiliently supported in the capsule but also because the compressor which is primarily responsible for the noise is surrounded not only by the capsule but also by the housing. Further, the housing serves as a transport abutment and therefore protects the compressor.

In particular, the housing and the capsule may be substantially cylindrical. The relative angular position between the housing and capsule is then not important. The capsule is of cartridge shape and can be easily assembled in all positions.

Further, the supporting springs may engage approximately centrally at opposite end walls of the housing. The springs therefore take up no radial space. The capsule can thus be kept very small in the radial direction.

Preferably, the partition is in the form of an insert. The result of this is that the motor and the compressor can be finally assembled outside the housing whereupon the entire arrangement need only be pushed into the housing.

Further, the first end wall may also be in the form of an insert which, after installation of the motor and the compressor, is simply attached as a closure. In general, a push fit suffices to keep the inserts securely in position.

Further, the tubular housing can be sectioned in the region of the stator, the one housing section being in one piece with a second end wall associated with the motor. This end wall can therefore also be secured on the stator simply by pushing on the associated housing section.

In a preferred embodiment, an oil collecting chamber is formed within the tubular housing between the first end wall and the partition, which oil collecting chamber is connected to the exterior chamber between the capsule and housing substantially only by way of a suction conduit section commencing at the base of said exterior chamber and out of which oil is fed to the bearing by pump means. In this way the entire intermediate space between the housing and capsule is substantially free from oil. There is no danger that sound oscillations are transmitted from the housing to the capsule by way of the oil sump. If oil reaches this exterior chamber, it is sucked into the oil collecting chamber together with the suction gas.

It is recommended that the motor shaft be substantially horizontal and the pump means be formed by a vane which is provided on the guide element and which conveys oil in a lubricating passage disposed in the partition above the bearing. This permits intensive lubrication, the oil having to traverse only a short path.

Advantageously, a return passage in the partition leads to the oil collecting chamber from a part of the bearing adjacent the motor. By means of the return passage, a considerably proportion of the lubricating oil returns direct to the oil collecting chamber. Only a negligibly small portion of the oil reaches the region of the motor. It is therefore possible to keep the air gap free from oil. The motor therefore has lower losses and can be designed to be smaller as a whole.

Further, the motor shaft can be approximately horizontal and at least one oil outlet aperture may be provided in the tubular housing near the partition. If, therefore, oil should escape from the bearing into the region of the motor, it immediately flows through the oil outlet aperture into the exterior chamber from which it is returned to the oil collecting chamber by means of the suction conduit section.

In this case the motor shaft may be inclined downwardly a few degrees from the horizontal as viewed from the motor. In this way oil that may have reached the air gap will flow off. This can, for example, occur in that the tubular housing is resiliently supported in the capsule at a slight inclination.

Further, the tubular housing may have gas apertures near the partition in the region of the second end wall. In this way one ensures circulation of the suction gas in the region of the motor. This flow of suction gas may be supported by fan blades on the rotor. Altogether, this leads to cooling of the motor.

It is of particular advantage for only one cylinder to be provided in the cylinder block to extend beyond the axis of the motor shaft. This leads to a cylinder block with extremely small radial dimensions so that the unit can be kept correspondingly small.

The guide element may comprise a pin on which the piston is supported by a semi-cylindrical surface. This permits the piston to be supported even when the cylinder axis is not precisely in registry with the axis of the eccentric surface. In particular, this permits the cylinder axis to be offset from the axis of the eccentric surface in the sense of a side pressure reduction during the compression stroke.

Further, the cylinder block may carry a cylinder cover with a suction valve chamber and a pressure valve chamber and suction and pressure plate valves may be provided between the block and cover. This construction is extremely favourable and is also suitable for a rotary cylinder block.

It is recommended that the cylinder block has at the end a pressure conduit connection which sealingly passes through the first end wall and opens in a pressure conduit chamber which is formed thereon and connected to the pressure connection of the capsule by way of a movable pressure conduit pipe. As a rule, no particular difficulties are encountered in sealing a rotary connection in a wall. The pressure conduit chamber can simultaneously serve as sound damping.

In particular, the seal can be made by a slide ring seal of which the supporting ring is sealingly held in the first end wall by an O-ring and of which the slide ring is sealingly held on the pressure conduit connection by an O-ring and is turned by said connection with the aid of an entrainment. Such a slide ring seal not only gives a high degree of sealing at the slide ring surface. Lubrication automatically takes place by means of the oil carried along by the pressure gas into the pressure conduit chamber. By reason of using the two O-sealing rings, slight angular motion and axial motion between the pressure conduit connection and the first end wall is harmless.

Because of the increased pressure in the pressure conduit chamber, the slide ring seal need be axially loaded only by the pressure difference between the pressure in the pressure conduit chamber and the pressure in the oil collecting chamber. A special slide ring spring can therefore be omitted.

With particular advantage, the supporting ring is of metal and the slide ring of polytetrafluoroethylene and a proportion of for example 25% carbon.

The invention will now be described in more detail with reference to the example illustrated in the drawing, wherein.

Figure 1:
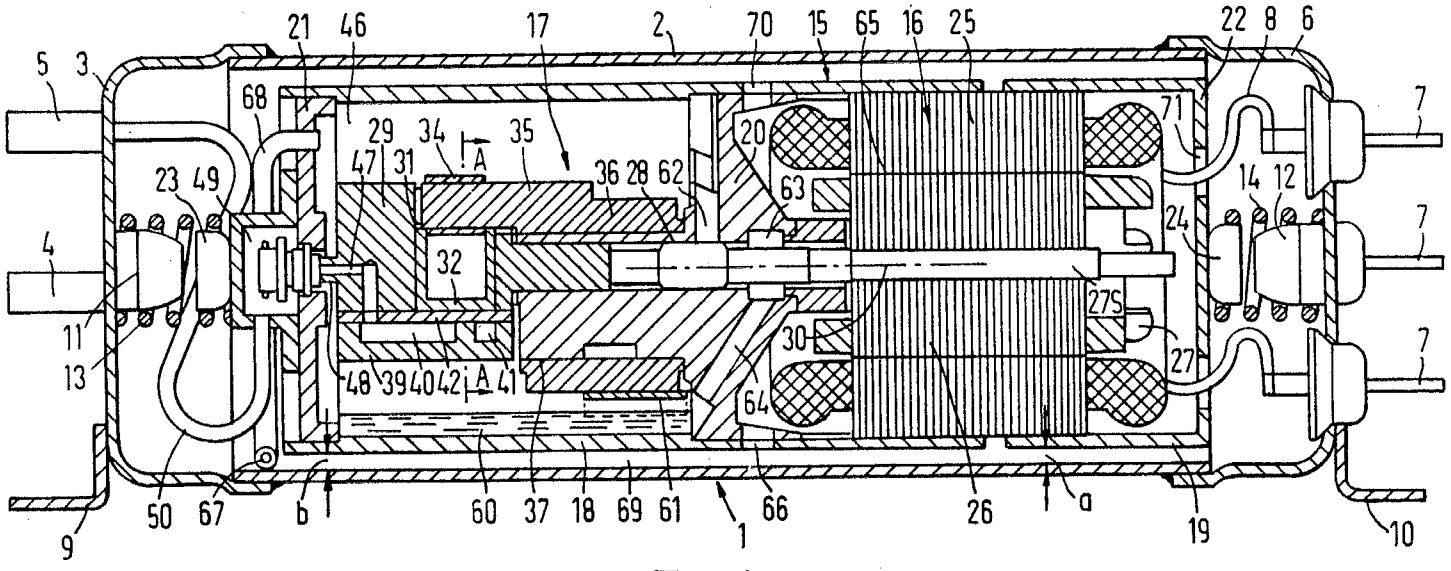
FIG. 1 is a longitudinal section through a refrigerant compressor unit according to the invention.
Figure 2:
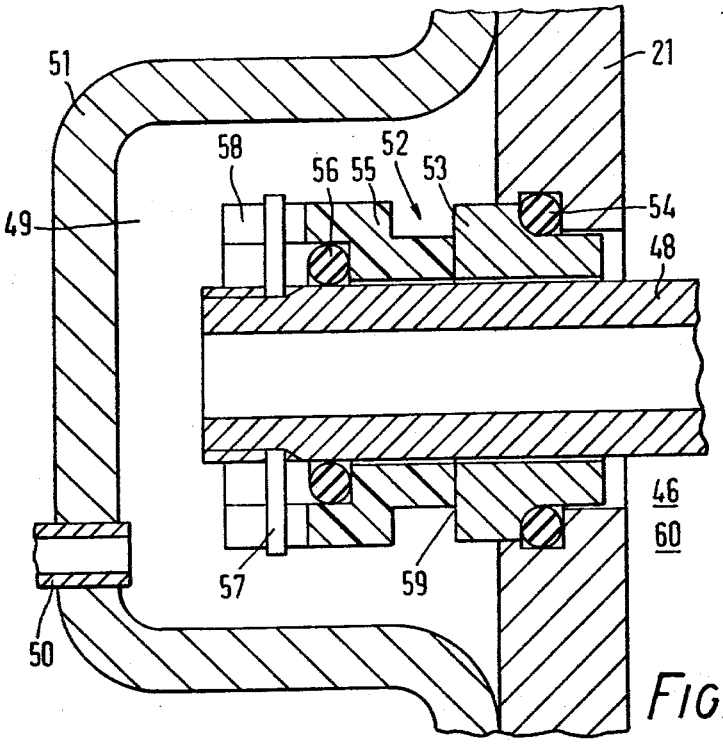
FIG. 2 is an enlarged section of the pressure conduit connection and the pressure conduit chamber.
Figure 3:
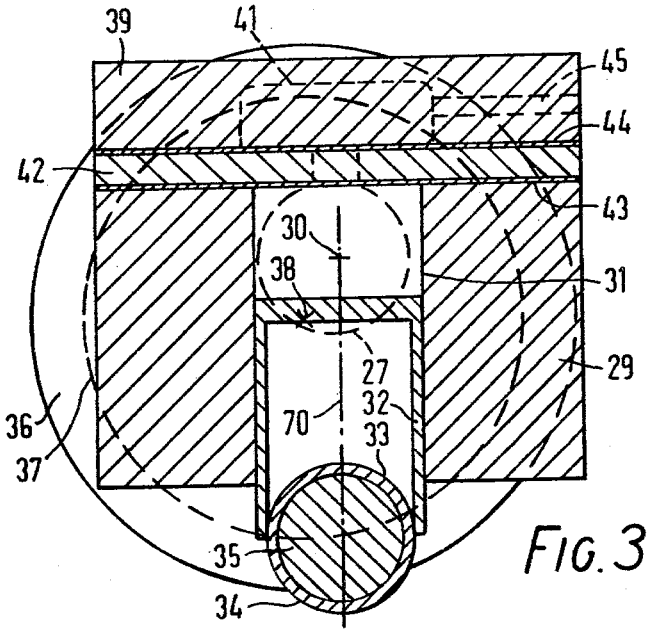
FIG. 3 is a diagrammatic cross-section of the cylinder block in a position turned through 180° along the line A—A in FIG. 1.

The illustrated compressor unit has a stroke chamber of 1.5 $cm^3$, a capsule diameter of 7.5 cm and a length of 21.5 cm.

A capsule 1 consists of a cylinder 2, an end cover 3 through which a suction gas connection 4 and a pressure gas connection 5 pass, and an end cover 6 which has three passages 7 for motor leads 8. A mounting foot 9 or 10 is provided on the exterior of each cover and a holder 11 or 12 at the interior for receiving a respective axially extending supporting spring 13 or 14 for a housing 15.

This housing encloses an electric motor 16 and a compressor 17. It consists of two cylindrical peripheral sections, namely an axially longer section 18 and an axially shorter section 19. A partition 20 and a first end wall 21 are pressed into the longer section. The second section is formed in one piece with a second end wall 22. Both end walls in turn comprise a mounting 23 or 24 for the supporting spring 13 or 14. Both housing sections 18 and 19 are pushed onto the stator 25 of the motor 16 and are in this way interconnected. The rotor 26 which is provided with fan blades 27 in conventional manner drives a motor shaft 275 which is mounted in a bearing 28 formed by a hole in the partition 20.

Beyond the bearing 28 there is a cylinder block 29 which is formed in one piece with the motor shaft 27 or is fixed to rotate therewith and which has a single cylinder 31 projecting beyond the motor axis 30. In it there is a piston 32 supported by a semi-cylindrical surface 33 on a pin 35 which is provided with a slide bush 34 and is part of a guide element 36 that can move on the partition 20 around a cylindrical eccentric surface 37. The axis 38 of this eccentric surface is laterally offset from the central axis 70 of the cylinder 31 so that the side pressure forces are reduced during the compression stroke, so that the pin 35 may have a relatively small spacing from the axis 30. Upon rotation of the cylinder block 29, the piston 32 is carried along and pressed outwardly under centrifugal force. By way of the pin 35, the piston in turn takes along the guide element 36 which consequently brings about an eccentric path for the piston in relation to the cylinder block and thus one piston stroke. The cylinder block is covered by a cylinder cover 39 having a pressure valve chamber 40 and a suction valve chamber 41. Between the block and cover there is a valve plate 42 covered on one side by a plate 43 forming a suction valve plate and on the other side by a plate forming a pressure valve plate 44. The suction valve chamber communicates by way of a suction passage 45 with the chamber 46 between the first end wall 21 and the partition 20 as well as with the housing section 18 which projects completely over the compressor. A rotating pressure conduit section 47 leads from the pressure valve chamber 40 to a pressure conduit connection 48 which passes through the partition 21 and is formed at the end of the cylinder block 29.

This pressure conduit connection opens in a pressure conduit chamber 49 from which a movable pressure conduit pipe 50 leads to the pressure connection 5 at the capsule. This chamber 49 also serves as a sound damping chamber. It is formed between the end wall 21 and a cup 51 secured thereto. To seal the pressure conduit connection 48 in the end wall 21 there is a slide ring seal 52. Its supporting ring 53 of metal such as steel is sealingly held in the end wall 21 by means of an O-sealing ring 54. The slide ring 55, which can for example consist of polytetrafluoroethylene and 25% carbon, is sealingly held on the pressure conduit connection 48 by an O-sealing ring 56. An entrainment 57, which is secured to the pressure conduit connection 48, engages in axial slots 58 of the slide ring 55 so that the latter is turned by the connection 48. Since the pressure conduit chamber 49 is at compressor pressure but the chamber 46 is at suction pressure, the slide ring 55 is pressed against the supporting ring 53 with a force corresponding to the pressure difference, so that an adequately large sealing pressure occurs at the running face 59. It will be evident that, by reason of using the two O-sealing rings 54 and 56, inaccuracies in the movement between the pressure conduit connection 48 and end wall 21 can be compensated.

The lower portion of the chamber 46 serves as an oil collecting chamber 60. One or more blades 61 connected to the guide element 36 convey the oil upwardly, namely into a lubricating passage 62 disposed above the bearing 28. The oil conveyed to this location is distributed in the bearing 28 to both sides. The oil entering in the direction of the cylinder block falls back direct into the oil collecting chamber 60. Oil penetrating in the direction of the motor is wiped off by means of wiper means 63 and returns to the oil collecting chamber 60 through a return passage 64 in the partition 20. This provides a very short oil circuit with very little danger of the oil reaching the region of the motor 16 and giving rise to friction losses in its air gap 65. For the case where oil nevertheless reaches the motor side of the partition 20, an oil outlet aperture 66 is provided at the underside of the housing 15. The oil thus located as a thin layer on the base of the capsule is thus fed back together with the suction gas by way of the orifice 67 of a suction conduit section 68 into the chamber 45 and thus back to the oil collecting chamber 60. The motor shaft 27 and thus also the air gap 65 should have a slight inclination to the compressor 17 because oil can then also flow off out of the oil gap by way of the oil outlet aperture 66. This can either occur in that the mounting foot 10 is a little higher than the mounting foot 9 or in that the housing 15 is resiliently suspended in the capsule 1 with a slight inclination so that the lower portion of the outer chamber 69 between the housing and capsule has a somewhat larger height a in the region of the motor than the height b in the region of the cylinder.

Further, gas passages 70 and 71 are provided in the housing to both sides of the motor. Under the influence of the fan blades 27, suction gas is conveyed by way of these apertures through the air gap and cooling of the motor is thereby effected.

It will be clear from the construction that the overall dimensions of the capsule can be kept extraordinarily small in two directions. Further, in addition to the resilient suspension, good sound damping is achieved in that the motor and compressor are encapsulated twice, namely once by the housing 15 and again by the capsule 1, and because the outer chamber 69 contains no oil bridge for transmitting sound. Altogether, one obtains a quiet unit of which the noise level is reduced by 25 to 45 decibel. In addition, the housing also protects the motor and compressor during transporting. The gap between the housing and capsule can therefore be reduced to the smallest dimension required for operation.

We claim:

1. A compressor assembly, comprising, an electric motor having a stator and a rotor, housing means comprising inner and outer casing means with said inner casing means being attached to said stator, said inner casing means being resiliently mounted relative to said outer casing means and there being formed therebetween a first gas inlet chamber, shaft means for said rotor, bearing means fixed relative to said inner casing for journaling said shaft means, a compressor inside said inner casing having a cylinder block attached to said shaft means for rotation with said rotor, a second inlet gas chamber inside said inner casing in surrounding relation to said cylinder block, said cylinder block having a cylinder extending transversely relative to the axis of said shaft means, a piston in said cylinder, circular track means fixed relative to said inner casing and eccentrically disposed relative to the axis of said shaft means, guide means cooperable with said track means and said piston to cause reciprocation of said piston in synchronism with the rotation of said shaft means, intake and exhaust passage means in said cylinder block with said exhaust passage means having a terminal section coaxially aligned with the axis of said shaft means, said inner casing having end wall means, sealing means cooperable with said end wall means and said cylinder block, an antechamber wall attached to said inner casing wall means in surrounding relation to said sealing means and forming an antechamber between said first and second chambers, said antechamber having fluid communication with said exhaust passage terminal section, first and second exhaust port means in said outer casing means and said antechamber wall, and conduit means between said first and second exhaust port means.

2. A compressor assembly according to claim 1 wherein said inner and outer casing means have substantially cylindrical shapes.

3. A compressor assembly according to claim 1 including resilient mounting means between said inner and outer casing means, said resilient mounting means including springs at opposite ends of said inner casing means arranged coaxially relative to the axis of said shaft means.

4. A compressor assembly according to claim 1 including a fixed wall insert between said motor and said compressor attached to said inner casing and including said bearing means.

5. A compressor assembly according to claim 1 wherein said wall means having said sealing means is an insert.

6. A compressor assembly according to claim 1 wherein said inner casing means includes two tubularly shaped sections attached separately in spaced relation to each other to said stator.

7. A compressor assembly according to claim 4 wherein the bottom of said second inlet gas chamber forms an oil collecting chamber between said inner casing end wall and said fixed wall insert, pumping means for pumping oil from said oil collecting chamber to said bearing means, a suction port in said end wall means and a pipe from said suction port to the bottom of said outer casing means for sucking up oil which leaks from said bearing means to the bottom of said outer casing means.

8. A compressor assembly according to claim 7 wherein said shaft means is substantially horizontal and said pumping means are formed by a vane attached to said guide means.

9. A compressor assembly according to claim 1 wherein said guide means includes a horizontally extending cylindrically shaped pin, said piston having a semicylindrically shaped recess in which said pin is disposed in driving relation.

10. A compressor assembly according to claim 1 wherein the axis of said cylinder is off-set from the axis of said guide means.

11. A compressor assembly according to claim 1 including a cylinder cover attached to said cylinder block, said cover having a suction valve chamber and a pressure valve chamber, and suction and pressure plate valves provided between said block and said cover.

12. A compressor assembly according to claim 1 wherein said sealing means includes fixed and rotatable parts with engaging annularly shaped faces.

13. A compressor assembly according to claim 12 wherein said rotatable part is axially loaded only by the pressure difference between the pressure in said antechamber and the pressure in said second gas inlet chamber.

* * * * *